US009303458B2

(12) United States Patent
Van Den Steen et al.

(10) Patent No.: US 9,303,458 B2
(45) Date of Patent: Apr. 5, 2016

(54) METHOD AND SYSTEM FOR RADIALLY EXPANDING A TUBULAR ELEMENT

(75) Inventors: Leon Van Den Steen, Rijswijk (NL); Petrus Cornelis Kriesels, Rijswijk (NL)

(73) Assignee: Shell Oil Company, Houston, TX (US)

( * ) Notice: Subject to any disclaimer, the term of this patent is extended or adjusted under 35 U.S.C. 154(b) by 372 days.

(21) Appl. No.: 13/990,953

(22) PCT Filed: Dec. 1, 2011

(86) PCT No.: PCT/EP2011/071456

§ 371 (c)(1),
(2), (4) Date: May 31, 2013

(87) PCT Pub. No.: WO2012/072720

PCT Pub. Date: Jun. 7, 2012

(65) Prior Publication Data

US 2013/0239643 A1 Sep. 19, 2013

(30) Foreign Application Priority Data

Dec. 3, 2010 (EP) ..... 10193582

(51) Int. Cl.

| | |
|---|---|
| ***E21B 7/20*** | (2006.01) |
| ***E21B 36/04*** | (2006.01) |
| ***B21D 7/16*** | (2006.01) |
| ***B21D 7/00*** | (2006.01) |
| ***E21B 43/10*** | (2006.01) |

(52) U.S. Cl.

CPC ... *E21B 7/20* (2013.01); *B21D 7/00* (2013.01); *B21D 7/162* (2013.01); *E21B 43/103* (2013.01)

(58) Field of Classification Search

CPC ..... E21B 7/20; E21B 23/00; E21B 29/02; E21B 36/04; B21D 7/00; B21D 9/18; B21D 7/162; E21D 9/00

See application file for complete search history.

(56) References Cited

U.S. PATENT DOCUMENTS

| | | | | |
|---|---|---|---|---|
| 4,064,211 | A | 12/1977 | Wood | 264/95 |
| 4,431,069 | A | 2/1984 | Dickinson, III | |
| 4,501,337 | A | 2/1985 | Dickinson et al. | 175/171 |
| 6,109,828 | A | 8/2000 | Keller | |
| 6,446,670 | B1 | 9/2002 | Woodward | |
| 7,281,422 | B2 | 10/2007 | Keller | |
| 7,946,349 | B2 | 5/2011 | Kriesels | |

(Continued)

FOREIGN PATENT DOCUMENTS

| | | | |
|---|---|---|---|
| CN | 1246084 | 3/2000 | |
| CN | 02814404 | 9/2006 | |
| CN | 101490362 | 7/2009 | |
| CN | 101542070 | 9/2009 | |
| EP | 0044706 | 7/1981 | E21B 7/00 |
| EP | 1438483 | 4/2006 | E21B 43/10 |

(Continued)

OTHER PUBLICATIONS

PCT International Search Report, Application No. PCT/EP2011/071456 dated Jan. 2, 2012.

*Primary Examiner* — Cathleen Hutchins

(57) ABSTRACT

The invention relates to a system and method for radially expanding a tubular element (8). The method comprises the steps of bending the tubular element (8) radially outward and in axially reverse direction so as to form an expanded tubular section (10) extending around an unexpanded tubular section (8) wherein bending occurs in a bending zone (14); and increasing the length of the expanded tubular section (10) by inducing the bending zone (14) to move in axial direction relative to the unexpanded tubular section (8). The method includes the further step of heating the bending zone. Several embodiments to enable heating are described.

10 Claims, 8 Drawing Sheets

(56) References Cited

U.S. PATENT DOCUMENTS

| | | | | |
|---|---|---|---|---|
| 2004/0094538 | A1* | 5/2004 | Larive et al. | 219/619 |
| 2005/0172710 | A1 | 8/2005 | Keller | 73/152.41 |
| 2009/0120688 | A1* | 5/2009 | Fabris | 175/18 |
| 2009/0288842 | A1* | 11/2009 | Kriesels | 166/384 |

FOREIGN PATENT DOCUMENTS

| | | | |
|---|---|---|---|
| WO | WO2008006841 | 1/2008 | E21B 43/10 |
| WO | WO2008049826 | 5/2008 | E21B 43/10 |
| WO | WO2008061969 | 5/2008 | E21B 43/10 |
| WO | WO2009074643 | 6/2009 | E21B 43/10 |

* cited by examiner

FIG. 5
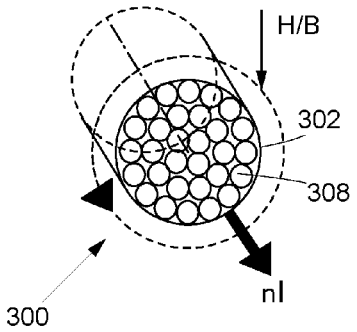
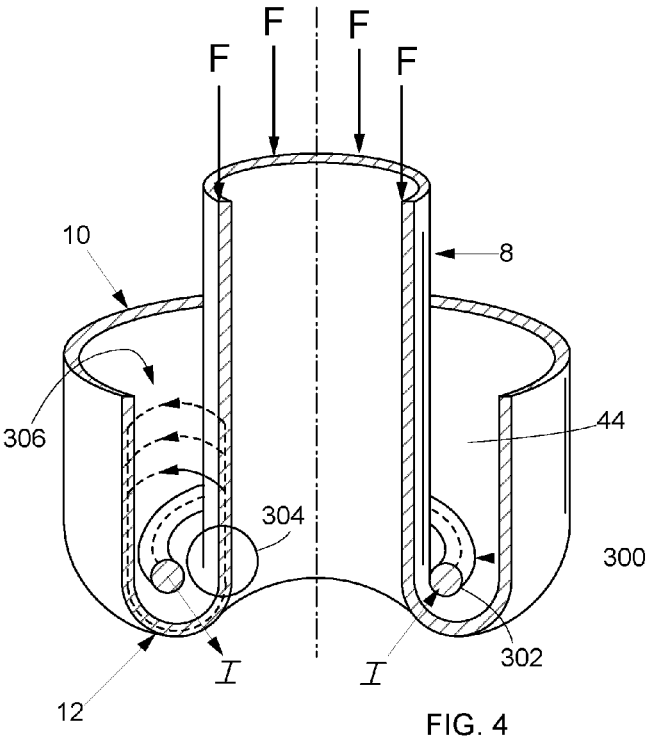
FIG. 4
FIG. 6
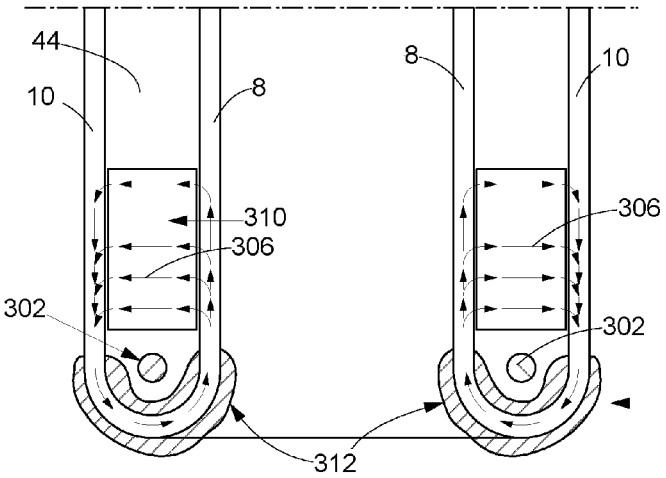
FIG. 7
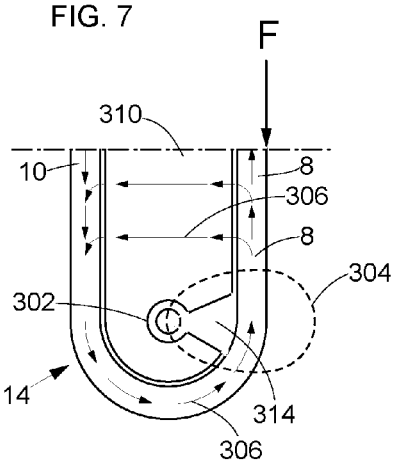

FIG. 9
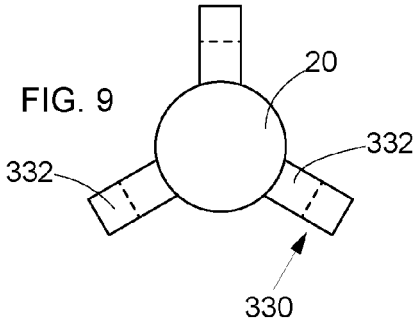
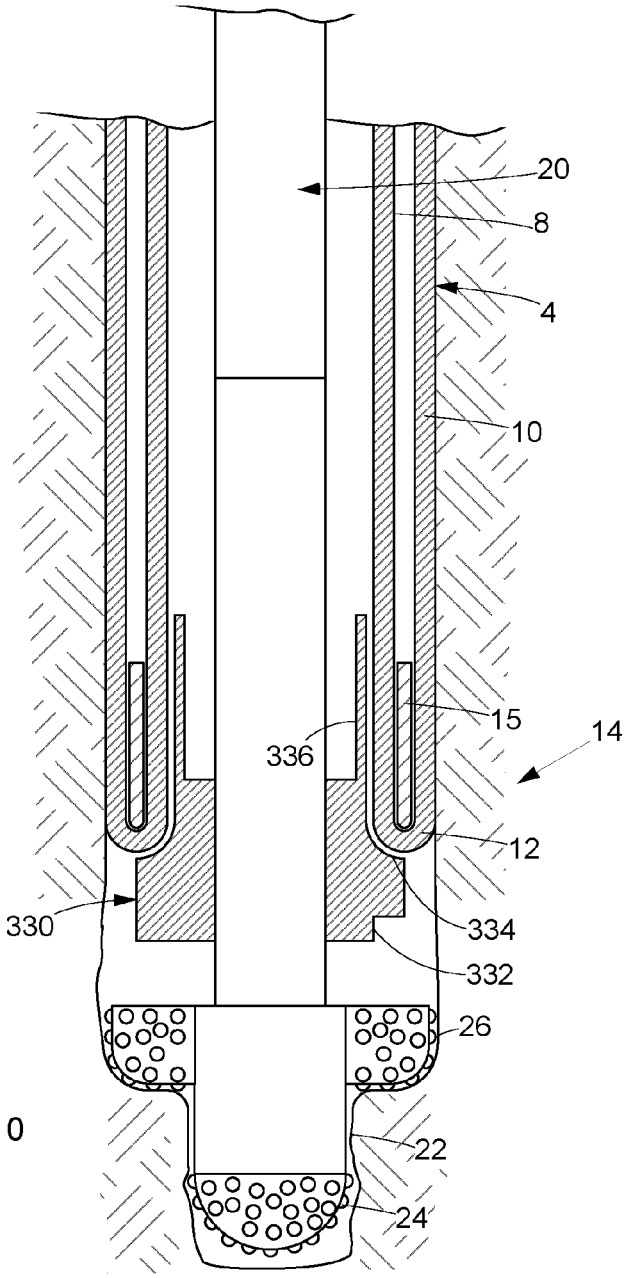
FIG. 10

FIG. 12
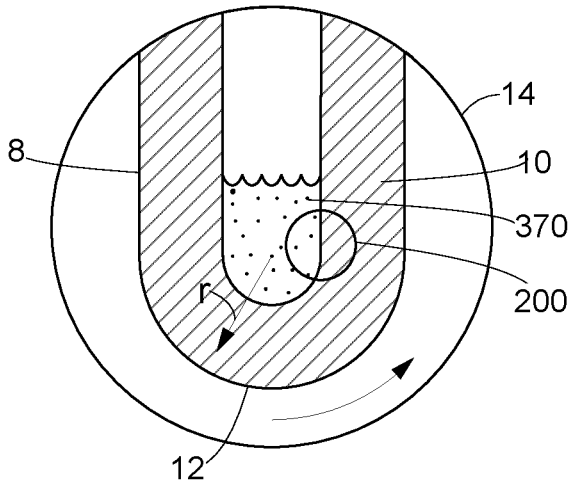
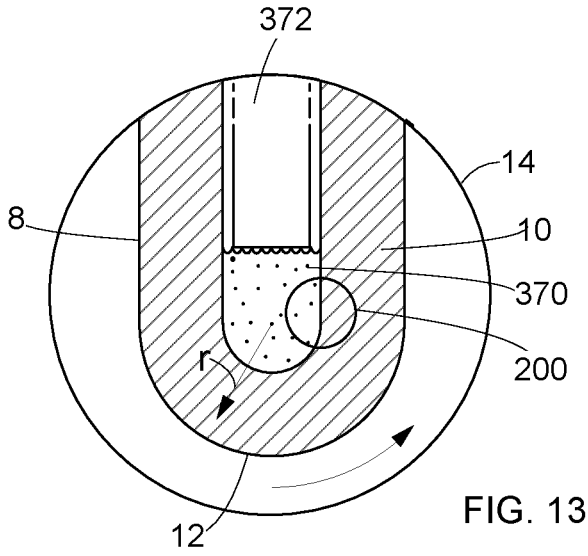
FIG. 13

METHOD AND SYSTEM FOR RADIALLY EXPANDING A TUBULAR ELEMENT

PRIORITY CLAIM

The present application claims priority from PCT/EP2011/071456, filed Dec. 1, 2011, which claims priority from European application 10193582.3, filed Dec. 3, 2010, which is incorporated herein by reference.

The present invention relates to a method and a system for radially expanding a tubular element. The method and system of the application can be applied for lining a wellbore.

The technology of radially expanding tubular elements in wellbores is increasingly applied in the industry of oil and gas production. Wellbores are generally provided with one or more casings or liners to provide stability to the wellbore wall and/or to provide zonal isolation between different earth formation layers. The terms "casing" and "liner" refer to tubular elements for supporting and stabilising the wellbore wall, whereby it is generally understood that a casing extends from surface into the wellbore and that a liner extends from a downhole location further into the wellbore. However, in the present context, the terms "casing" and "liner" are used interchangeably and without such intended distinction.

In conventional wellbore construction, several casings are set at different depth intervals, and in a nested arrangement. Herein, each subsequent casing is lowered through the previous casing and therefore has a smaller diameter than the previous casing. As a result, the cross-sectional wellbore size that is available for oil and gas production decreases with depth.

To alleviate this drawback, it is possible to radially expand one or more tubular elements at a desired depth in the wellbore, for example to form an expanded casing, expanded liner, or a clad against an existing casing or liner.

Also, it has been proposed to radially expand each subsequent casing to substantially the same diameter as the previous casing to form a monodiameter wellbore. It is thus achieved that the available diameter of the wellbore remains substantially constant along (a section of) its depth as opposed to the conventional nested arrangement.

EP-1438483-B1 discloses a method of radially expanding a tubular element in a wellbore whereby the tubular element, in unexpanded state, is initially attached to a drill string during drilling of a new wellbore section. Thereafter the tubular element is radially expanded and released from the drill string.

To expand such wellbore tubular element, generally a conical expander is used with a largest outer diameter substantially equal to the required tubular diameter after expansion. The expander is pumped, pushed or pulled through the tubular element. Such method can lead to high friction forces that need to be overcome, between the expander and the inner surface of the tubular element. Also, there is a risk that the expander becomes stuck in the tubular element.

EP-0044706-A2 discloses a method of radially expanding a flexible tube of woven material or cloth by eversion thereof in a wellbore, to separate drilling fluid pumped into the wellbore from slurry cuttings flowing towards the surface. The woven material or cloth has however insufficient strength to support the borehole wall and to replace conventional casing.

Although in some applications the known expansion techniques have indicated promising results, there is a need for an improved method of radially expanding a tubular element.

WO-2008/006841 discloses a wellbore system for radially expanding a tubular element in a wellbore. The wall of the tubular element is induced to bend radially outward and in axially reverse direction so as to form an expanded section extending around an unexpanded section of the tubular element. The length of the expanded tubular section is increased by pushing the unexpanded section into the expanded section. Herein the expanded section retains the expanded tubular shape after eversion. At its top end, the unexpanded section can be extended, for instance by adding pipe sections or by unreeling, folding and welding a sheet of material into a tubular shape.

With the system of WO-2008/006841 damage to the material of the pipe in the form of cracks can occur when the material of the pipe is straightened after the inversion thereof, when the wall of the pipe is too thick or when properties of the pipe material are insufficient to support a certain wall thickness. This problem can in principle be avoided by either using a pipe with a wall thickness below a predetermined threshold and/or by using material which is sufficiently ductile.

For certain predetermined well conditions, in terms of pore pressures around the inverted pipe and possible gas or liquid influxes from the formation, it may be desirable to use a stronger pipe, to be able to withstand the internal (burst) and external (collapse) pressure differentials that the pipe may experience in the wellbore.

The present invention aims to improve the above described method and system.

The invention therefore provides a method for radially expanding a tubular element, the method comprising the steps of:

bending the tubular element radially outward and in axially reverse direction so as to form an expanded tubular section extending around an unexpanded tubular section, wherein bending occurs in a bending zone;

increasing the length of the expanded tubular section by inducing the bending zone to move in axial direction relative to the unexpanded tubular section; and heating the bending zone.

Thus, the tubular element is effectively turned inside out during the bending process. The bending zone defines the location where the bending process takes place. By inducing the bending zone to move in axial direction along the tubular element it is achieved that the tubular element is progressively expanded without the need for an expander that is pushed, pulled or pumped through the tubular element.

With the method of the invention damage to the tubular element due to inversion is prevented, enabling the use of tubular elements having a thicker wall. Such thicker wall will be stronger, increasing the burst strength and collapse strength of the tubular element inverted with the method of the invention. The heated bending zone decreases the force required to invert the tubular element, limiting the force to be applied to the unexpanded section at surface.

It is preferred that the tubular element includes a material that is plastically deformed in the bending zone during the bending process so that the expanded tubular section retains an expanded shape as a result of said plastic deformation. In this manner it is achieved that the expanded tubular section retains its shape due to plastic deformation, i.e. permanent deformation, of the wall. Thus, the expanded tubular section maintains its expanded shape, without the need for an external force or pressure to maintain its expanded shape. If, for example, the expanded tubular section has been expanded against the wellbore wall as a result of said bending of the wall, no external radial force or pressure needs to be exerted to the expanded tubular section to keep it against the wellbore wall.

Suitably the wall of the tubular element comprises a metal, such as steel or any other ductile metal capable of being plastically deformed by eversion of the tubular element. The expanded tubular section then has adequate collapse resistance, for example in the order of 100 or 150 bars or more.

If the tubular element extends vertically in the wellbore, the weight of the unexpanded tubular section can be utilised to contribute to the force needed to induce downward movement of the bending zone.

Suitably the bending zone is induced to move in axial direction relative to the unexpanded tubular section by inducing the unexpanded tubular section to move in axial direction relative to the expanded tubular section. For example, the expanded tubular section is held stationary while the unexpanded tubular section is moved in axial direction through the expanded tubular section to induce said bending of the wall.

In order to induce said movement of the unexpanded tubular section, preferably the unexpanded tubular section is subjected to an axially compressive force acting to induce said movement. The axially compressive force preferably at least partly results from the weight of the unexpanded tubular section. If necessary the weight can be supplemented by an external, downward, force applied to the unexpanded tubular section to induce said movement. As the length, and hence the weight, of the unexpanded tubular section increases, an upward force may need to be applied to the unexpanded tubular section to prevent uncontrolled bending or buckling in the bending zone.

If the bending zone is located at a lower end of the tubular element, whereby the unexpanded tubular section is axially shortened at a lower end thereof due to said movement of the bending zone, it is preferred that the unexpanded tubular section is axially extended at an upper end thereof in correspondence with said axial shortening at the lower end thereof. The unexpanded tubular section gradually shortens at its lower end due to continued reverse bending of the wall. Therefore, by extending the unexpanded tubular section at its upper end to compensate for shortening at its lower end, the process of reverse bending the wall can be continued until a desired length of the expanded tubular section is reached. The unexpanded tubular section can be extended at its upper end, for example, by connecting a tubular portion to said upper end in any suitable manner such as by welding. Alternatively, the unexpanded tubular section can be provided in the form of a coiled tubing which is unreeled from a reel and gradually inserted into the wellbore. Thus, the coiled tubing is extended at its upper end by unreeling from the reel.

As a result of forming the expanded tubular section around the unexpanded tubular section, an annular space is formed between the unexpanded and expanded tubular sections. To increase the collapse resistance of the expanded tubular section, a pressurized fluid can be inserted into the annular space. The fluid pressure can result solely from the weight of the fluid column in the annular space, or in addition also from an external pressure applied to the fluid column.

The expansion process is suitably initiated by bending the wall of the tubular element at a lower end portion thereof.

Advantageously the wellbore is being drilled with a drill string extending through the unexpanded tubular section. In such application the unexpanded tubular section and the drill string may be lowered simultaneously during drilling with the drill string.

To reduce any buckling tendency of the unexpanded tubular section during the expansion process, the unexpanded tubular section may be centralised within the expanded section by any suitable centralising means.

The invention will be described hereinafter in more detail and by way of example, with reference to the accompanying drawings, wherein:

FIG. 4 shows a perspective view of a detail of an embodiment of the present invention;

FIG. 5 shows a cross section of an electric coil of the embodiment of FIG. 4;

FIG. 6 shows a cross section of another embodiment of the present invention;

FIG. 7 shows a cross section of yet another embodiment of the present invention;

FIG. 9 shows a schematic plan view of an embodiment of the invention;

FIG. 10 shows a cross section of the embodiment of FIG. 9;

FIG. 12 shows a cross section of an embodiment of the invention; and

FIG. 13 shows a cross section of another embodiment of the invention.

In the Figures and the description like reference numerals relate to like components.

Figure 1:
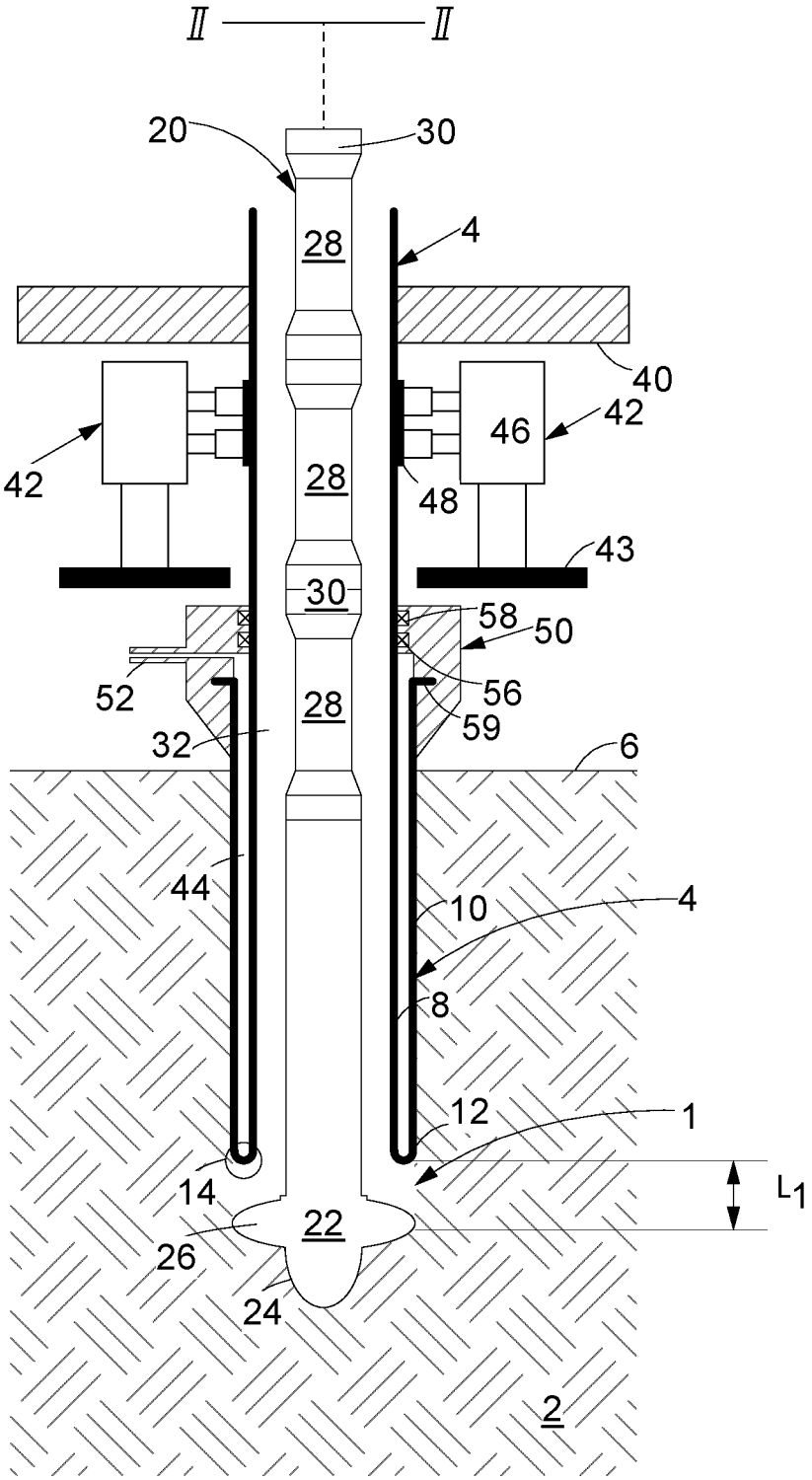
FIG. 1 shows a vertical cross section of a lower part of a system for radially expanding a tubular element.

FIG. 1 shows a wellbore 1 formed in an earth formation 2. A radially expandable tubular element 4, for instance an expandable steel liner, extends from surface 6 down into the wellbore 1. The tubular element 4 comprises an unexpanded tubular section 8 and a radially expanded tubular section 10. The unexpanded section 8 extends within the expanded section 10. Preferably, an outer diameter of the expanded tubular section 10 is substantially equal to the diameter of the wellbore 1.

Although the wellbore shown in FIG. 1 extends vertically into the formation 2, the present invention is equally suitable for any other wellbore. For instance, the wellbore 1 may extend at least partially in horizontal direction. Herein below, upper end of the wellbore refers to the end at surface 6, and lower end refers to the end down hole.

At its lower end, the wall of the unexpanded section 8 bends radially outward and in axially reverse (in FIG. 1 the upward) direction so as to form a curved lower section 12, defining a bending zone 14 of the tubular element 4. The curved section 12 is U-shaped in cross-section and interconnects the unexpanded section 8 and the expanded section 10.

A drill string 20 may extend from surface through the unexpanded liner section 8 to the lower end of the wellbore 1. The lower end of the drill string 20 is provided with a drill bit 22. The drill bit comprises, for instance, a pilot bit 24 having an outer diameter which is slightly smaller than the internal diameter of the unexpanded liner section 8, and a reamer section 26 having an outer diameter adapted to drill the wellbore 1 to its nominal diameter. The reamer section 26 may be radially retractable to a smaller outer diameter, allowing it to pass through the unexpanded liner section 8, so that the drill bit 22 can be retrieved through the unexpanded liner section 8 to surface. The drill string 20 may comprise multiple drill pipe sections 28. The pipe sections 28 may be mutually connected at respective ends by male and female threaded connections 30. An annular space 32 between the drill string 20 and the unexpanded tubular section 8 is referred to as the drilling annulus 32.

The connections 30 are not shown in detail, but comprise for instance threaded, pin and box type connections. The connections 30 may comprise joints fabricated with male threads on each end, wherein short-length coupling members (not shown) with female threads are used to join the individual joints of drill string together, or joints with male threads on one end and female threads on the other. Said threaded connections may comprise connections which are standardized by the American Petroleum Institute (API).

FIG. 1 also shows a rig floor 40, which is elevated with respect to the surface 6 and encloses an upper end of the drill string 20 and of the unexpanded tubular section 8. The rig floor 40 is part of a drilling rig, which is however not shown in its entirety. A pipe pusher 42, which is for instance arranged below the rig floor, may enclose the unexpanded section 8. The pipe pusher is for instance supported by base frame 45. The base frame 45 provides stability, and may for instance be connected to the drilling rig or be supported at surface 6. The pipe pusher may comprise one or more motors 46, which are arranged on the base frame, and one or more conveyer belts 48 which can be driven by the respective motors. Each conveyer belt 48 engages the outside of the unexpanded section 8. The conveyer belts 48 can exert force to said unexpanded section 8 to force the unexpanded section to move into the expanded section 10. Other embodiments of the pipe pusher 42 are conceivable, which will be able to exert downward or upward force to the unexpanded section.

A sealing device 50 can be connected to the upper end of the expanded liner section 10 to seal the unexpanded liner section 8 relative to the expanded liner section 10. Herein, the sealing device 50 enables the unexpanded liner section 8 to slide in axial direction relative to the sealing device 50. The sealing device comprises a conduit 52 which is connected to a pump (not shown) for pumping fluid into or out of a blind annulus 43, i.e. the annular space between the unexpanded liner section 8 and the expanded liner section 10. The annular space 44 is referred to as blind annulus as it is closed at the downhole end by the bending zone 14. The sealing device includes one, two or more annular seals 56, 58. The seals 56, 58 engage the outside of the unexpanded section 8 and prevent said fluid to exit the blind annulus. Preferably, the sealing device 50 comprises at least two seals 56, 58 to provide at least one additional seal to improve safety and reliability in case the first seal may fail.

The sealing device 50 can be regarded as a blind annulus blow out preventer (BABOP). Therefore, the seals 56, 58, the connection of the device 50 to the upper end of expanded section 10, and one or more valves (not shown) for closing conduit 52 will all be designed to at least withstand fluid pressures that may arise in a well control situation. Depending on specifics of the formation, the sealing device 50 is for instance designed to withstand pressures that may be expected in case of a blowout, for instance in the range of 200 bar to 1600 bar, for instance about 400 bar to 800 bar or more. Such pressures may for instance arise in the blind annulus 44 in case of a failure, for instance due to rupture, of the expandable tubular 4 in combination with a well control situation.

The expanded liner section 10 is axially fixed, by any suitable fixation means, to prevent axial movement.

The expanded liner section 10 may be fixated at its upper end at surface. For instance, said upper end of the expanded section may be connected to a ring or flange 59, for instance by welding and/or screwing. Said ring can be attached to or incorporated in any suitable structure at surface, such as the sealing device 50. The inner diameter of said ring may be larger than the outer diameter of the expanded section. Optionally, the expanded section 10 may be fixed to the wellbore wall 12, for instance by virtue of frictional forces between the expanded liner section 10 and the wellbore wall 12 as a result of the expansion process. Alternatively, or in addition, the expanded liner section 10 can be anchored, for instance to the wellbore wall, by any suitable anchoring means.

Figure 2:
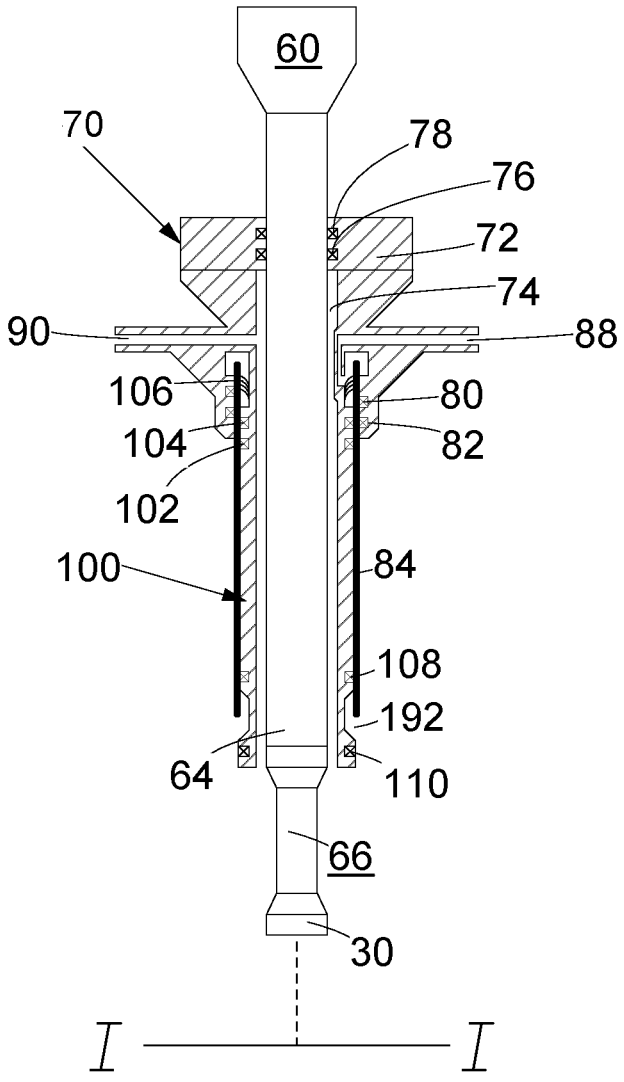
FIG. 2 shows a vertical cross section of an example of an upper part of the system of FIG. 1.
Figure 3:
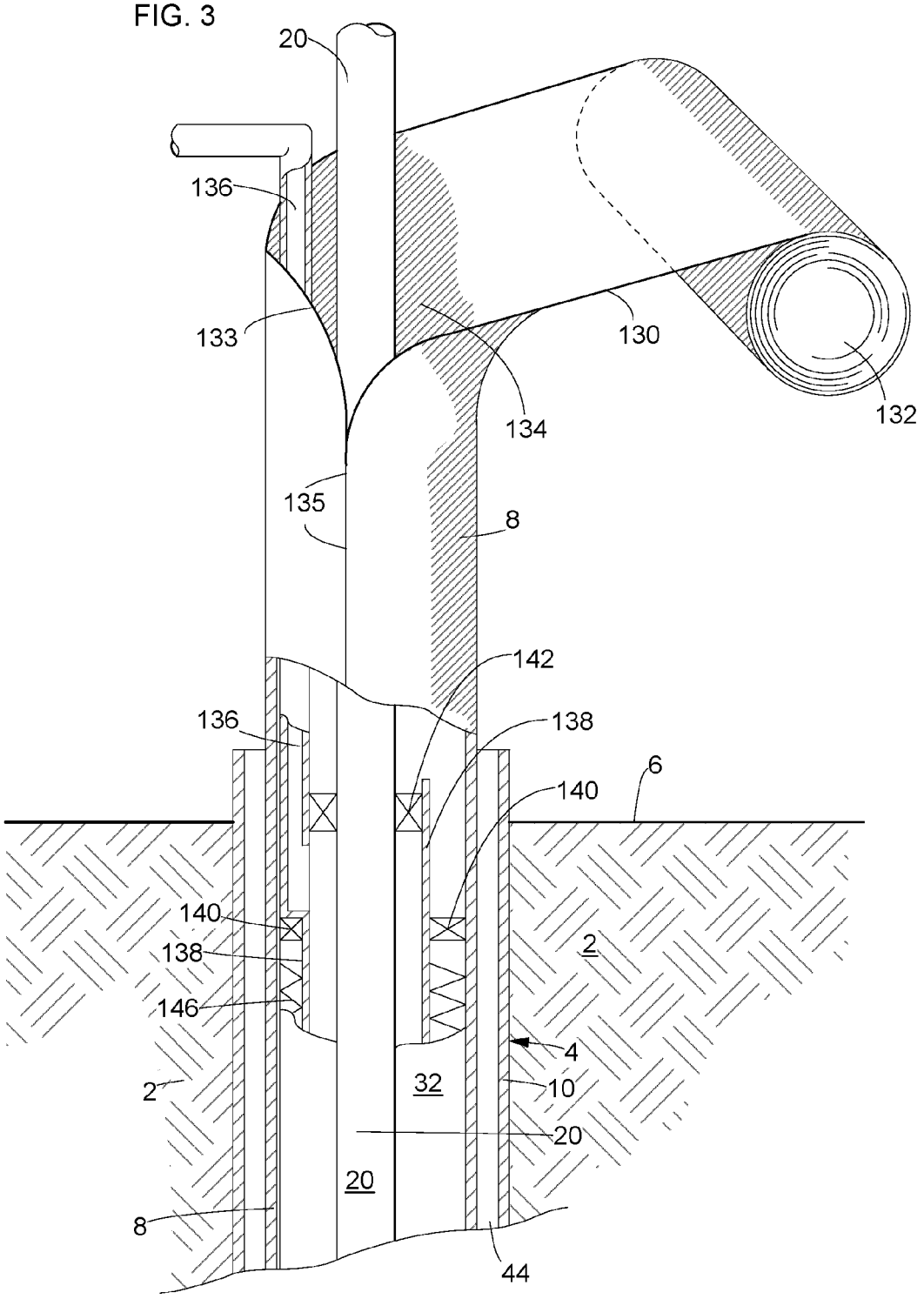
FIG. 3 shows a vertical cross section of another example of an upper part of the system of FIG. 1.

At the interface indicated by the line II-II, the lower portion of the system shown in FIG. 1 can be connected to an upper portion as for instance shown in FIGS. 2 and 3.

FIG. 2 shows a top drive 60 connected to an upper end connection part 62, which is rotatable with respect to the top drive. Preferably, the upper end connection part comprises a flush pipe, having a smooth outer surface. The pipe end 64, which is remote from the top drive, is provided with a threaded connection 30 as described above. The threaded end 64 is connected to an additional drill string section 66. Typically, the additional drill string section 66 will be substantially equal to the drill string sections 28, shown in FIG. 1. At the interface indicated by line I-I, the additional drill pipe section 66 can be connected to the upper end of the drill string 20 shown in FIG. 1.

A drilling annulus sealing device 70 may cover the top end of the drilling annulus 32. The sealing device 70 comprises a housing 72, which encloses the connection part 62 and provides an internal space 74. At the top end, near the top drive 60, the housing comprises one, two or more seals 76, 78, which engage the outside of the pipe 62. Preferably, the seals 76, 78 enable the housing to slide along the pipe 62. At the opposite end, the housing may comprise one, two or more seals 80, 82 which engage the outside of an additional expandable pipe section 84. In addition to the seals, the housing may comprise grippers 106, which may engage the outside and/or the inside of the pipe section 84. An activation line 88 is connected to the housing for activating or releasing the seals 80, 82 and/or the grippers 86. A fluid conduit 90 is connected to the internal space 74 for supply or drainage of (drilling) fluid to or from the annular space 32.

The sealing device 70 may comprise an extending part or stinger 100. The stinger extends into the inside of the additional expandable pipe section 84. The stinger may comprise seals 102, 104 and/or grippers 106 to engage the upper end of the pipe section 84. The stinger may also comprise seals 108 to engage a lower end of the pipe section 84, and seals 110 to engage the inside of the upper end of the unexpanded tubular section 8 (shown in FIG. 1). A backing gas tool 192 may be integrated in the stinger between the seals 108, 110. The backing gas tool covers the inner interface between the additional expandable pipe section 84 and the unexpanded tubular section 8.

The stinger may be at least slightly longer than the pipe section 84 so that the stinger may extend into the unexpanded section 8, which will enable the stinger to function as an alignment tool for aligning the pipe section 84 and the unexpanded section 8.

In practice, the length of the pipe section 84 may be in the range of about 5-20 meters, for instance 10 meters. The stinger will for instance be about 2% to 10% longer, for instance 5% longer than the pipe section 84. An annular space 112 is provided between the stinger and the pipe 62 to provide a fluid connection from the annulus 32 to the space 74 and the conduit 90.

The sealing device 70 may be referred to as drilling annulus blow out preventer (DABOP) 70. The seals 76-82, the grippers 86, and one or more valves (not shown) for closing conduits 88 and 90 will all be designed to at least withstand fluid pressures that may arise in a well control situation. Depending on specifics of the formation and the expected maximum pore pressures, the DABOP 70 is for instance designed to withstand pressures in the range of about 200 bar to 800 bar or more, for instance about 400 bar.

The DABOP may comprise any number of seals. The DABOP 70 may comprise one seal 76 and one seal 80, or a plurality of seals. In a practical embodiment, two seals 76, 78 to seal with respect to the pipe 62 and two seals to seal with respect to the tubular section 84 will provide a balance between for instance fail-safety and reliability on one hand and costs on the other hand. For instance, the double barrier provided by the inner seals 102, 104, engaging the inside of the expandable pipe 84, and the outer seals 80, 82, engaging the outside of the expandable pipe 84, improves the reliability and leak-tightness of the sealing device 70.

FIG. 3 shows an upper portion of the system of FIG. 1. The unexpanded liner section 8 is at its upper end formed from a (metal) sheet 130 wound on a reel 132. The metal sheet 130 has opposite edges 133, 134. After unreeling from the reel 132, the metal sheet 130 is bent into a tubular shape and the edges 133, 134 are interconnected, for instance by welding, to form the unexpanded tubular section 8. Consequently, the expandable tubular element 4 may comprise a longitudinal weld 135.

A fluid conduit 136 extends from the interior of the unexpanded tubular section 8, to above the upper end of the unexpanded tubular section 8. The fluid conduit 136 may at its lower end be connected to, or integrally formed with, a tube 138 located in the unexpanded tubular section 8. A first annular seal 140 seals the tube 138 relative to the unexpanded liner section 8, and a second annular seal 142 seals the tube 138 relative to the drill string 20. The fluid conduit 136 is in fluid communication with the interior space of the tube 38 via an opening 144 provided in the wall of the tube 138. Furthermore the tube 138 is provided with gripper means 146 allowing upward sliding, and preventing downward sliding, of the tube 138 relative to the unexpanded liner section 8. The first annular seal 140 allows upward sliding of the tube 138 relative to the unexpanded liner section 8.

The upper portion shown in FIG. 3 can be combined with the lower portion shown in FIG. 1, wherein the unexpanded tubular section 8 is however continuously formed around the drill string 20. Herein, some of the features shown in FIG. 1 are omitted in FIG. 3 to improve the clarity of the latter figure, such as the sealing device 50, the pipe pusher 42 and drilling floor 40.

The invention relates to the inversion of a tubular element 4. The inverted tubular element may form a conduit, or constitute a lining of a wellbore or of an existing pipe, see FIG. 1. Herein, damage to the material of the tubular element, for instance in the form of cracks, can occur when the material is straightened after the inversion has been completed. Cracks may typically occur on the inside surface of the expanded section 10. Such damage can for instance occur when the wall of the original, unexpanded pipe is too thick and/or when the material properties of the pipe are insufficient to support a certain wall thickness.

The outside of the unexpanded section, which will become the inside of the inverted or expanded section, undergoes the largest deformation in terms of total strain and hence is the most vulnerable to cracking. The amount of deformation is inversely proportional to the knuckle radius r. Herein, the knuckle radius r is the radius of the middle of the cross section of the curved section 12.

Locally heating the tubular element near the bending zone reduces the strain in the area of deformation, thereby improving the integrity of the expanded section. Improving the integrity includes the reduction or elimination of damage, such as cracks. As a result, heating the bending zone enables the use of pipes having a thicker and stronger wall.

The wall thickness of the tubular element may be equal to or thicker than about 2 mm (0.08 inch). The wall is for instance more than 2.5 mm thick, for instance about 2.8 to 50 mm thick or about 3 to 30 mm. The outer diameter of the unexpanded section may be larger than 50 mm (2 inch), for instance in the range of about 50 to 400 mm (16 inch). The expanded section may have an outer diameter suitable for or commonly used in hydrocarbon production.

The wall of the liner may comprise a relatively strong material, such as a metal or preferably steel, or be made of solid metal or steel. Thus, the liner 4 can be designed to have adequate collapse strength to support a wellbore wall and/or to withstand internal or external pressures encountered when drilling for hydrocarbon reservoirs.

The collapse strength of the tubular element can be set at any predetermined level, depending on wall thickness and material properties. In practical embodiments, the collapse strength of the tubular element 4 can be in the range of 200 bar to 1600 bar or more.

In an embodiment, a heating element 300 includes an electric coil 302. FIG. 4 shows the electric coil 302 being arranged in the blind annulus 44 between the expanded section 10 and the unexpanded section 8. The coil 302 is located near the U-shaped section 12. The heating element is preferably able to heat the bending zone 14, including the inversion location 304. The inversion location is the location where the inversion of the tubular element 4 commences.

The coil 302 is connected to an electrical power source, which can provide current I to the coil, for instance in a direction indicated by the arrows in FIG. 4. Said current I will induce a magnetic field around the coil, wherein the magnetic flux is indicated by flux lines 306.

Alternatively, the electric coil may include multiple electrical wires 308, to increase the magnetic field. When the coil 302 includes n wires 308, the total current through the coil will be nI amps, as indicated in FIG. 5. Herein, H/B indicates the magnetic field intensity/the induction field.

In the embodiment shown in FIG. 6, a flux conductor 310 is arranged in conjunction with the electrical coil 302. The flux conductor is for instance cylindrically shaped and arranged above the coil, in the blind annulus 44. The flux conductor comprises, or may be entirely made of, a low loss, high $\mu_r$ material. Said material is preferably a ferromagnetic material, for instance Fe304. Due to the flux conductor, heat induced by the magnetic field of the electric coil can be concentrated in a predetermined heat concentration area 312. Herein, low loss implies a lower loss compared to losses in the material of the tubular element 4. When the tubular element is made of steel, the losses therein will be much larger than in the flux conductor 310 made of Fe304.

As shown in FIG. 7, the flux conductor 310 may at least partially enclose the electric coil 302. Herein, the flux conductor is preferably provided with a ring-shaped opening 314. Said opening enables a more precise determination of the heat concentration area 312, for instance more concentrated at or near the inversion location 304.

Figure 8:
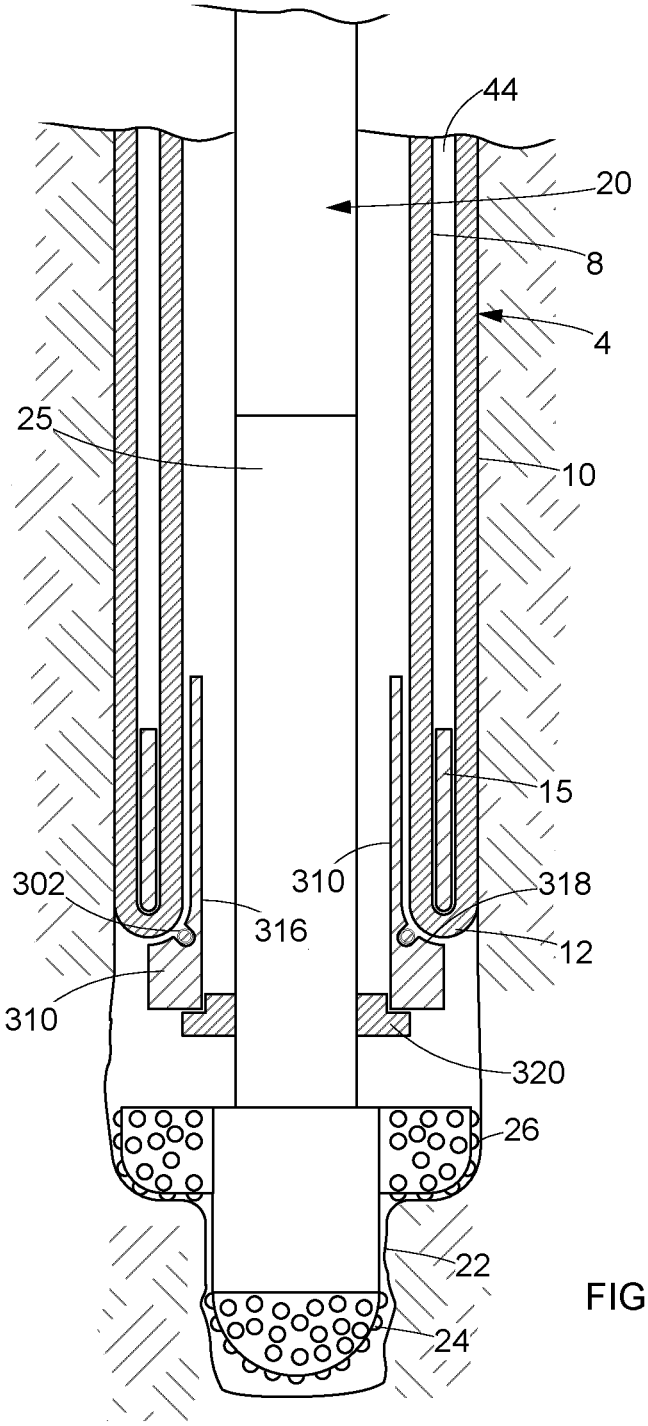
FIG. 8 shows a cross section of an embodiment of the invention.

Optionally, the electrical coil 302 may be arranged on the inside of the unexpanded section 8, as shown in FIG. 8. Herein, the coil 302 can be embedded in a ring-shaped cavity 316 of the flux conductor 310. The flux conductor is for instance cylindrical, being provided with a curved surface 318 to complement the U-shaped section 12 of the liner. The flux conductor may be supported by supports 320 which are connected to the drill string 20. The supports may slide along the lower end of the flux conductor, so that the flux conductor may remain substantially stationary.

FIG. 8 also shows a cylindrical member 15 in the blind annulus 44, to support and control the bending of the liner 4. A bottom hole assembly 25 may be included at the end of the drill string 20 to drive the drill bit 22.

The electrical coil 302 is preferably connected to an AC power source at surface via electrical wires (not shown). Thus, the system including the electrical coil 302 can be compared to a transformer without a secondary coil. According to theory, the following losses will occur:

1) Hysteretic losses, increasing proportional to the frequency of the AC current;
2) Flux losses, related to magnetic flux taking a shortcut through air. Although these are not direct power losses, they do contribute to the reactive power required to magnetize the (typically copper) coil 302 and therefore add to the resistive losses in the coil 302;
3) Eddy current losses, i.e. losses due to circulating currents induced in the metal parts. In a transformer, these are normally minimized by using low-conductance core materials such as ferrites or laminated iron. In the present invention, the Eddy currents are on purpose the dominating effect, eclipsing the other losses.

The resistance of magnetizing a magnetic core can be expressed a magnetic reluctance R, which is the induced magnetic field B in Tesla divided by the magnetic field intensity H, so R=B/H.

The flux concentrator 310 provides a path of low resistance through the concentrator 310, as well as a path of high resistance and loss. The latter provides the heat concentration area 312, which as a result can be located at a predetermined location as shown in the Figures.

As shown in FIG. 10, the heating element may include friction means 330 for inducing heat due to friction between the friction means and the tubular element. The friction means may include one or more arms 332 which are connected to the drill string 20 and extend in radial direction (FIG. 9). Connected herein implies that the friction means rotate in conjunction with the drill string. During drilling, the drill string is rotated from surface to rotate the drill bit 22. The amount of friction induced heat can therefore be adjusted by adjusting the rotational speed of the drill string 20.

The friction arms 332 are for instance provided with a friction surface 334 which engages the inside of the unexpanded section 8 and (part of) the bending zone 14. Said friction surface is adapted to induce friction between said surface and the tubular element, to thereby produce heat. The friction surface may for instance be provided with a friction inducing material and/or with a machined (metal) surface.

The friction surface 334 has a shape which is complementary to the inner surface of the bending zone 14. The arms 332 preferably are shaped to induce heat at the preferred location. For instance, the arms 332 may extend in axial direction, indicated by axial extensions 336.

Figure 11:
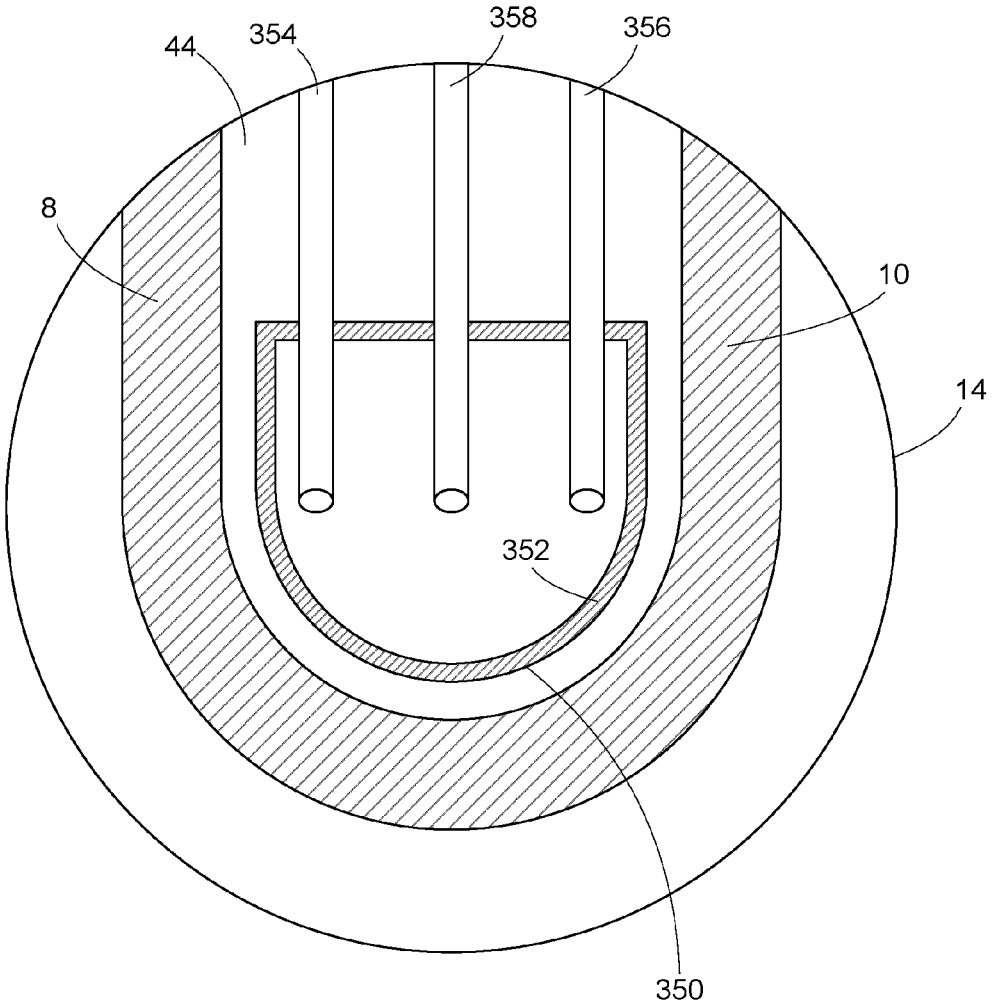
FIG. 11 shows a cross section of another embodiment of the invention.

In an alternative embodiment, the heating means include a mixer 350 which is arranged near the bending zone 14 (FIG. 11). The mixer may be a container 352 having two or more input conduits 354, 356 and at least one output conduit 358. Each input conduit can supply a fluid having a predetermined composition to the mixer. Herein, the fluids supplied by the first and second input conduits respectively will provide an exothermal reaction in the mixer 350. The heat of said reaction will heat the wall of the container 352, which will transfer said heat to the bending zone 14.

The mixer 350 may be located in the blind annulus 44. Alternatively, the mixer can be located within the unexpanded section. The latter embodiment has the advantage that the input and output conduits can be included in the drill string. Herein, the drill bit is preferably rotated by using a bottom hole assembly, s that the drill string is not rotated during drilling.

The embodiments described above may be combined with a heat transfer fluid 370, which is arranged in the blind annulus 44 (FIG. 12). The heat transfer fluid may facilitate the heat transfer and/or may ensure a uniform temperature of the bending zone 14.

Preferably, the fluid 370 solidifies below a threshold temperature which is chosen such that in the absence of heating by the above described heating means, the fluid will solidify, thus impeding the eversion of the liner 4. Said threshold temperature is (slightly) higher than the maximum temperature expected in a respective downhole application. For a typical wellbore, said maximum temperature may be in the range of 100 to 400 degree C.

The heat transfer fluid 370 can be combined with a conduction element 372 (FIG. 13). The heat conduction element 372 is cylindrical and solid. The heat conduction element transfers the generated heat away from the bending zone, to ensure a gradual decrease of the temperature further away from the bending zone and the fluid 370.

The operation of the system of the invention can be described referring to FIG. 1. The tubular element 4 extends into the wellbore 1. The liner 4 has been partially radially expanded by eversion of the wall thereof, forming a radially expanded tubular section 10 which extends concentrically around the unexpanded section 8. The liner 4 is, due to eversion at its lower end, bent radially outward and in axially reverse (for instance upward) direction so as to form a U-shaped lower section, defining the bending zone 14 (FIG. 1).

During normal operation of the system of the invention, the lower end portion of the yet unexpanded liner 4 is bent radially outward and in axially reverse direction in any suitable manner, forming the U-shaped lower section 12. After an predetermined length of the liner 4 has been everted, the expanded liner section 10 can be axially fixed by any suitable means.

As shown in FIG. 4, a downward force F of sufficient magnitude is then applied to the unexpanded liner section 8 in order to move the unexpanded liner section 8 gradually into the expanded liner section 10. As a result, the unexpanded section 8 progressively bends in reverse direction thereby progressively transforming the unexpanded liner section 8 into the expanded liner section 10. During the eversion process, the bending zone 14 moves at approximately half the speed of the unexpanded section 8.

If desired, the diameter and/or wall thickness of the liner 4 can be selected such that the expanded liner section 10 becomes firmly compressed against the wellbore wall as a result of the expansion process so as to seal against the wellbore wall and/or to stabilize the wellbore wall. Since the length, and hence the weight, of the unexpanded section 8 gradually increases, the magnitude of downward force F (FIG. 4) can be decreased gradually in correspondence with the increased weight of section 8.

When it is required to retrieve the drill string 24 to surface, for example when the drill bit is to be replaced or when drilling of the wellbore 1 is completed, the support ring 26 and reamer section 42 are radially retracted. Subsequently the drill string 24 is retrieved through the unexpanded liner section 8 to surface. The guide member 28 can remain downhole. Alternatively, the guide member 28 can be made collapsible so as to allow it to be retrieved to surface in collapsed mode through the unexpanded liner section 8.

With the method described above, it is achieved that the wellbore is progressively lined with the everted liner directly above the drill bit, during the drilling process. As a result, there is only a relatively short open-hole section of the wellbore during the drilling process at all times. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the short open-hole section L1 (see FIG. 1) during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice whereby casings of stepwise decreasing diameter must be set at selected intervals. Open hole section herein indicates the section of the wellbore which is not yet lined. With the system of the invention, the open hole section may have a length L1 smaller than about 500 m, for instance smaller than about 100 m.

Also, if the wellbore is drilled through a shale layer, such short open-hole section eliminates possible problems due to heaving of the shale.

After the wellbore 1 has been drilled to the desired depth and the drill string 24 has been removed from the wellbore, the length of unexpanded liner section 8 that is still present in the wellbore 1, can be left in the wellbore or it can be cut-off from the expanded section 10 and retrieved to surface.

In case the length of unexpanded liner section 8 is left in the wellbore 1, there are several options for completing the wellbore. These are, for example, as follows.

A) A fluid, for example brine, is pumped into the annular space between the unexpanded and expanded liner sections 8, 10 so as to pressurise the annular space and increase the collapse resistance of the expanded liner section 10. Optionally one or more holes are provided in the U-shaped lower sections 16, 20 to allow the pumped fluid to be circulated.

B) A heavy fluid is pumped into the annular space so as to support the expanded liner section 10 and increase its collapse resistance.

C) Cement is pumped into the annular space to create, after hardening of the cement, a solid body between the unexpanded liner section 8 and the expanded liner section 10, whereby the cement may expand upon hardening.

D) The unexpanded liner section 8 is radially expanded against the expanded liner section 10, for example by pumping, pushing or pulling an expander (not shown) through the unexpanded liner section 8.

In the above examples, expansion of the liner is started at surface or at a downhole location. In case of an offshore wellbore, wherein an offshore platform is positioned above the wellbore above the surface of the water, it can be advantageous to start the expansion process at the offshore platform. Herein, the bending zone moves from the offshore platform to the seabed and from there further into the wellbore. Thus, the resulting expanded tubular element not only forms a liner in the wellbore, but also a riser extending from the offshore platform to the seabed. The need for a separate riser from is thereby obviated.

Furthermore, conduits such as electric wires or optical fibres for communication with downhole equipment can be extended in the annular space between the expanded and unexpanded sections. Such conduits can be attached to the outer surface of the tubular element before expansion thereof. Also, the expanded and unexpanded liner sections can be used as electricity conductors to transfer data and/or power downhole.

Since any length of unexpanded liner section that is still present in the wellbore after the eversion process is finalised, is subjected to less stringent loading conditions than the expanded liner section, such length of unexpanded liner section may have a smaller wall thickness, or may be of lower quality or steel grade, than the expanded liner section. For example, it may be made of pipe having a relatively low yield strength or collapse rating.

Instead of leaving a length of unexpanded liner section in the wellbore after the expansion process, the entire liner can be expanded with the method of the invention so that no unexpanded liner section remains in the wellbore. In such case, an elongate member, for example a pipe string, can be used to exert the necessary downward force F to the unexpanded liner section during the last phase of the expansion process.

In order to reduce friction forces between the unexpanded and expanded tubular sections during the expansion process described in any of the aforementioned examples, suitably a friction reducing layer, such as a Teflon layer, is applied between the unexpanded and expanded tubular sections. For example, a friction reducing coating can be applied to the outer surface of the tubular element before expansion. Such layer of friction reducing material furthermore reduces the annular clearance between the unexpanded and expanded sections, thus resulting in a reduced buckling tendency of the unexpanded section. Instead of, or in addition to, such friction reducing layer, centralizing pads and/or rollers can be applied between the unexpanded and expanded sections to reduce the friction forces and the annular clearance there-between.

Instead of expanding the expanded liner section against the wellbore wall (as described above), the expanded liner section can be expanded against the inner surface of another tubular element already present in the wellbore.

The invention described herein above may be combined with rollers, as previously described in WO-2008/061969, and/or with longitudinal grooves on the outer surface or the inner surface of any of the layers, as described in WO-2008/049826 both of which are for this purpose enclosed herein by reference.

Numerous modifications of the above described embodiments are conceivable, within the scope of the attached claims. Features of respective embodiments may for instance be combined.

That which is claimed is:

1. A method for radially expanding a tubular element, the method comprising the steps of:

bending the tubular element radially outward and in axially reverse direction so as to form an expanded tubular section extending around an unexpanded tubular section, wherein bending occurs in a bending zone;

increasing the length of the expanded tubular section by inducing the bending zone to move in axial direction relative to the unexpanded tubular section; and heating the bending zone, wherein heating the bending zone includes activating a heating element which is arranged near the bending zone, wherein the heating element includes an electric coil arranged between the unexpanded section and the expanded section.

2. The method of claim 1, wherein the step of increasing the length of the expanded tubular section comprises pushing the unexpanded tubular section into the expanded tubular section.

3. The method of claim 1, wherein a drill string extends through the unexpanded tubular section, and wherein the drill string is operated to further drill the wellbore.

4. The method of claim 3, wherein the unexpanded tubular section and the drill string are simultaneously lowered through the wellbore during drilling with the drill string.

5. The method of claim 1, wherein the electric coil is attached to the drill string.

6. The method of claim 1, wherein a flux concentrator is arranged near the electric coil for concentrating an electromagnetic field.

7. The method of claim 1, wherein an annular space is formed between the unexpanded tubular section and the expanded tubular section, the method further comprising inserting a heat transfer fluid into the annular space.

8. The method of claim 7, wherein the heat transfer fluid solidifies below a threshold temperature, thereby stopping the step of increasing the length of the expanded tubular section by inducing the bending zone to move in axial direction.

9. The method of claim 1, further comprising:

axially extending the unexpanded tubular section at an upper end thereof.

10. A system for radially expanding a tubular element, comprising:

a tubular element being bent radially outward and in axially reverse direction so as to form an expanded tubular section extending around an unexpanded tubular section, wherein bending occurs in a bending zone;

a pipe pusher for increasing the length of the expanded tubular section by inducing the expanded tubular section to move in axial direction relative to the unexpanded tubular section; and a heating element arranged near the bending zone for heating the bending zone, wherein the heating element includes an electric coil arranged between the unexpanded section and the expanded section.

* * * * *